US006467259B1

(12) United States Patent
Surnilla et al.

(10) Patent No.: US 6,467,259 B1
(45) Date of Patent: Oct. 22, 2002

(54) METHOD AND SYSTEM FOR OPERATING DUAL-EXHAUST ENGINE

(75) Inventors: Gopichandra Surnilla, West Bloomfield, MI (US); David George Farmer, Plymouth, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/884,563

(22) Filed: Jun. 19, 2001

(51) Int. Cl.[7] ..... F01N 3/00

(52) U.S. Cl. ..... 60/285; 60/274; 60/286; 60/297

(58) Field of Search ..... 60/274, 276, 285, 60/286, 295, 297; 123/443

(56) References Cited

U.S. PATENT DOCUMENTS

| | | | |
|---|---|---|---|
| 3,696,618 | A | 10/1972 | Boyd et al. |
| 3,969,932 | A | 7/1976 | Rieger et al. |
| 4,033,122 | A | 7/1977 | Masaki et al. |
| 4,036,014 | A | 7/1977 | Ariga |
| 4,167,924 | A | 9/1979 | Carlson et al. |
| 4,178,883 | A | 12/1979 | Herth |
| 4,186,296 | A | 1/1980 | Crump, Jr. |
| 4,251,989 | A | 2/1981 | Norimatsu et al. |
| 4,533,900 | A | 8/1985 | Muhlberger et al. |

(List continued on next page.)

FOREIGN PATENT DOCUMENTS

| | | |
|---|---|---|
| DE | 196 07 151 C1 | 7/1997 |
| EP | 0 351 197 A2 | 1/1990 |
| EP | 0 444 783 A1 | 9/1991 |
| EP | 0 503 882 A1 | 9/1992 |
| EP | 0 508 389 A1 | 1/1994 |
| JP | 62-97630 | 5/1987 |
| JP | 62-117620 | 5/1987 |
| JP | 64-53042 | 3/1989 |
| JP | 2-30915 | 2/1990 |
| JP | 2-33408 | 2/1990 |
| JP | 2-207159 | 8/1990 |
| JP | 3-135147 | 6/1991 |
| JP | 5-26080 | 2/1993 |
| JP | 5-106493 | 4/1993 |
| JP | 5-106494 | 4/1993 |
| JP | 6-58139 | 3/1994 |
| JP | 6-264787 | 9/1994 |
| JP | 7-97941 | 4/1995 |
| WO | WO 98/27322 | 6/1998 |

OTHER PUBLICATIONS

C. D. De Boer et al., "Engineered Control Strategies for Improved Catalytic Control of $NO_x$ in Lean Burn Applications," SAE Technical Paper No. 881595, Oct. 10–13, 1988.

Y. Kaneko et al., "Effect of Air–Fuel Ratio Modulation on Conversion Efficiency of Three–Way Catalysts," SAE Technical Paper No. 780607, Jun. 5–9, 1978, pp. 119–127.

(List continued on next page.)

*Primary Examiner*—Thomas Denion
*Assistant Examiner*—Binh Tran
(74) *Attorney, Agent, or Firm*—Julia Voutyras; Allan Lippa

(57) ABSTRACT

An exhaust gas treatment system for an internal combustion engine includes a pair of upstream emission control devices which respectively receive the exhaust gas generated by a respective group of cylinders, and a single, shared downstream emission control device receiving catalyzed exhaust gas from each of the upstream emission control devices. After the downstream device stores a selected constituent gas generated when each cylinder group is operating "lean," the downstream device is purged by operating the first cylinder group with a stoichiometric air-fuel mixture while operating the second cylinder group with a rich air-fuel mixture, such that the combined catalyzed exhaust gas flowing through the downstream device during the purge event has an air-fuel ratio slightly rich of stoichiometry. As a result, the invention improves overall vehicle fuel economy because only one of the upstream devices is purged of stored oxygen when purging the downstream device of previously-stored constituent gas.

13 Claims, 1 Drawing Sheet

U.S. PATENT DOCUMENTS

| | | | | |
|---|---|---|---|---|
| 4,622,809 | A | | 11/1986 | Abthoff et al. |
| 4,677,955 | A | | 7/1987 | Takao |
| 4,854,123 | A | | 8/1989 | Inoue et al. |
| 4,884,066 | A | | 11/1989 | Miyata et al. |
| 4,913,122 | A | | 4/1990 | Uchida et al. |
| 4,964,272 | A | | 10/1990 | Kayanuma |
| 5,009,210 | A | | 4/1991 | Nakagawa et al. |
| 5,088,281 | A | | 2/1992 | Izutani et al. |
| 5,097,700 | A | | 3/1992 | Nakane |
| 5,165,230 | A | | 11/1992 | Kayanuma et al. |
| 5,174,111 | A | | 12/1992 | Nomura et al. |
| 5,189,876 | A | | 3/1993 | Hirota et al. |
| 5,201,802 | A | | 4/1993 | Hirota et al. |
| 5,209,061 | A | | 5/1993 | Takeshima |
| 5,222,471 | A | | 6/1993 | Stueven |
| 5,233,830 | A | | 8/1993 | Takeshima et al. |
| 5,267,439 | A | | 12/1993 | Raff et al. |
| 5,270,024 | A | | 12/1993 | Kasahara et al. |
| 5,272,871 | A | | 12/1993 | Oshima et al. |
| 5,325,664 | A | | 7/1994 | Seki et al. |
| 5,331,809 | A | | 7/1994 | Takeshima et al. |
| 5,335,538 | A | | 8/1994 | Blischke et al. |
| 5,357,750 | A | | 10/1994 | Ito et al. |
| 5,359,852 | A | | 11/1994 | Curran et al. |
| 5,377,484 | A | | 1/1995 | Shimizu |
| 5,402,641 | A | | 4/1995 | Katoh et al. |
| 5,410,873 | A | | 5/1995 | Tashiro |
| 5,412,945 | A | | 5/1995 | Katoh et al. |
| 5,412,946 | A | | 5/1995 | Oshima et al. |
| 5,414,994 | A | | 5/1995 | Cullen et al. |
| 5,419,122 | A | | 5/1995 | Tabe et al. |
| 5,423,181 | A | | 6/1995 | Katoh et al. |
| 5,426,934 | A | | 6/1995 | Hunt et al. |
| 5,433,074 | A | | 7/1995 | Seto et al. |
| 5,437,153 | A | | 8/1995 | Takeshima et al. |
| 5,448,886 | A | | 9/1995 | Toyoda |
| 5,448,887 | A | | 9/1995 | Takeshima |
| 5,450,722 | A | | 9/1995 | Takeshima et al. |
| 5,452,576 | A | | 9/1995 | Hamburg et al. |
| 5,472,673 | A | | 12/1995 | Goto et al. |
| 5,473,887 | A | | 12/1995 | Takeshima et al. |
| 5,473,890 | A | | 12/1995 | Takeshima et al. |
| 5,483,795 | A | | 1/1996 | Katoh et al. |
| 5,531,972 | A | | 7/1996 | Rudy |
| 5,544,482 | A | | 8/1996 | Matsumoto et al. |
| 5,551,231 | A | | 9/1996 | Tanaka et al. |
| 5,554,269 | A | | 9/1996 | Joseph et al. |
| 5,569,848 | A | | 10/1996 | Sharp |
| 5,577,382 | A | | 11/1996 | Kihara et al. |
| 5,595,060 | A | | 1/1997 | Togai et al. |
| 5,598,703 | A | | 2/1997 | Hamburg et al. |
| 5,617,722 | A | | 4/1997 | Takaku |
| 5,622,047 | A | | 4/1997 | Yamashita et al. |
| 5,626,014 | A | | 5/1997 | Hepburn et al. |
| 5,626,117 | A | | 5/1997 | Wright et al. |
| 5,655,363 | A | | 8/1997 | Ito et al. |
| 5,657,625 | A | | 8/1997 | Koga et al. |
| 5,693,877 | A | | 12/1997 | Ohsuga et al. |
| 5,713,199 | A | | 2/1998 | Takeshima et al. |
| 5,715,679 | A | | 2/1998 | Asanuma et al. |
| 5,722,236 | A | | 3/1998 | Cullen et al. |
| 5,724,808 | A | | 3/1998 | Ito et al. |
| 5,729,971 | A | | 3/1998 | Matsuno et al. |
| 5,732,554 | A | | 3/1998 | Sasaki et al. |
| 5,735,119 | A | | 4/1998 | Asanuma et al. |
| 5,737,917 | A | | 4/1998 | Nagai |
| 5,740,669 | A | | 4/1998 | Kinugasa et al. |
| 5,743,084 | A | | 4/1998 | Hepburn |
| 5,743,086 | A | | 4/1998 | Nagai |
| 5,746,049 | A | | 5/1998 | Cullen et al. |
| 5,746,052 | A | | 5/1998 | Kinugasa et al. |
| 5,752,492 | A | | 5/1998 | Kato et al. |
| 5,771,685 | A | | 6/1998 | Hepburn |
| 5,771,686 | A | | 6/1998 | Pischinger et al. |
| 5,778,666 | A | | 7/1998 | Cullen et al. |
| 5,792,436 | A | | 8/1998 | Feeley et al. |
| 5,802,843 | A | | 9/1998 | Kurihara et al. |
| 5,803,048 | A | | 9/1998 | Yano et al. |
| 5,806,306 | A | | 9/1998 | Okamoto et al. |
| 5,813,387 | A | | 9/1998 | Minowa et al. |
| 5,831,267 | A | | 11/1998 | Jack et al. |
| 5,832,722 | A | | 11/1998 | Cullen et al. |
| 5,842,339 | A | | 12/1998 | Bush et al. |
| 5,842,340 | A | | 12/1998 | Bush et al. |
| 5,862,661 | A | | 1/1999 | Zhang et al. |
| 5,865,027 | A | | 2/1999 | Hanafusa et al. |
| 5,867,983 | A | | 2/1999 | Otani |
| 5,877,413 | A | | 3/1999 | Hamburg et al. |
| 5,910,096 | A | | 6/1999 | Hepburn et al. |
| 5,929,320 | A | | 7/1999 | Yoo |
| 5,934,072 | A | | 8/1999 | Hirota et al. |
| 5,938,715 | A | | 8/1999 | Zhang et al. |
| 5,953,907 | A | | 9/1999 | Kato et al. |
| 5,966,930 | A | | 10/1999 | Hatano et al. |
| 5,970,707 | A | | 10/1999 | Sawada et al. |
| 5,974,788 | A | | 11/1999 | Hepburn et al. |
| 5,974,791 | A | | 11/1999 | Hirota et al. |
| 5,974,793 | A | | 11/1999 | Kinugasa et al. |
| 5,974,794 | A | | 11/1999 | Gotoh et al. |
| 5,979,161 | A | | 11/1999 | Hanafusa et al. |
| 5,979,404 | A | | 11/1999 | Minowa et al. |
| 5,983,627 | A | | 11/1999 | Asik |
| 5,992,142 | A | | 11/1999 | Pott |
| 5,996,338 | A | | 12/1999 | Hirota |
| 6,003,308 | A | | 12/1999 | Tsutsumi et al. |
| 6,012,282 | A | | 1/2000 | Kato et al. |
| 6,012,428 | A | | 1/2000 | Yano et al. |
| 6,014,859 | A | | 1/2000 | Yoshizaki et al. |
| 6,023,929 | A | | 2/2000 | Ma |
| 6,026,640 | A | | 2/2000 | Kato et al. |
| 6,047,542 | A | * | 4/2000 | Kinugasa et al. ..... 60/274 |
| 6,058,700 | A | | 5/2000 | Yamashita et al. |
| 6,073,440 | A | | 6/2000 | Douta et al. |
| 6,079,204 | A | | 6/2000 | Sun et al. |
| 6,092,021 | A | | 7/2000 | Ehlbeck et al. |
| 6,092,369 | A | | 7/2000 | Hosogai et al. |
| 6,101,809 | A | | 8/2000 | Ishuzuka et al. |
| 6,102,019 | A | | 8/2000 | Brooks |
| 6,105,365 | A | | 8/2000 | Deeba et al. |
| 6,119,449 | A | | 9/2000 | Köhler |
| 6,128,899 | A | | 10/2000 | Oono et al. |
| 6,134,883 | A | | 10/2000 | Kato et al. |
| 6,138,453 | A | | 10/2000 | Sawada et al. |
| 6,145,302 | A | | 11/2000 | Zhang et al. |
| 6,145,305 | A | | 11/2000 | Itou et al. |
| 6,148,611 | A | | 11/2000 | Sato |
| 6,148,612 | A | | 11/2000 | Yamashita et al. |
| 6,161,378 | A | | 12/2000 | Hanaoka et al. |
| 6,161,428 | A | | 12/2000 | Esteghlal et al. |
| 6,164,064 | A | | 12/2000 | Pott |
| 6,189,523 | B1 | | 2/2001 | Weisbrod et al. |
| 6,199,373 | B1 | | 3/2001 | Hepburn et al. |
| 6,202,406 | B1 | | 3/2001 | Griffin et al. |
| 6,205,773 | B1 | | 3/2001 | Suzuki |
| 6,214,207 | B1 | | 4/2001 | Miyata et al. |
| 6,216,448 | B1 | | 4/2001 | Schnaibel et al. |
| 6,216,451 | B1 | | 4/2001 | Schnaibel et al. |
| 6,233,923 | B1 | | 5/2001 | Itou et al. |
| 6,237,330 | B1 | | 5/2001 | Takahashi et al. |
| 6,244,046 | B1 | | 6/2001 | Yamashita |
| 6,250,074 | B1 | * | 6/2001 | Suzuki et al. ..... 60/285 |

OTHER PUBLICATIONS

W. H. Holl, "Air–Fuel Control to Reduce Emissions I. Engine–Emissions Relationships," SAE Technical Paper No. 800051, Feb. 25–29, 1980.

A. H. Meitzler, "Application of Exhaust–Gas–Oxygen Sensors to the Study of Storage Effects in Automotive Three–Way Catalysts," SAE Technical Paper No. 800019, Feb. 25–29, 1980.

J. Theis et al., "An Air/Fuel Algorithm to Improve the $NO_x$ Conversion of Copper–Based Catalysts," SAE Technical Paper No. 922251, Oct. 19–22, 1992.

W. Wang, "Air–Fuel Control to Reduce Emissions, II. Engine–Catalyst Characterization Under Cyclic Conditions," SAE Technical Paper No. 800052, Feb. 25–29, 1980.

T. Yamamoto et al., "Dynamic Behavior Analysis of Three Way Catalytic Reaction," JSAE 882072–882166.

* cited by examiner

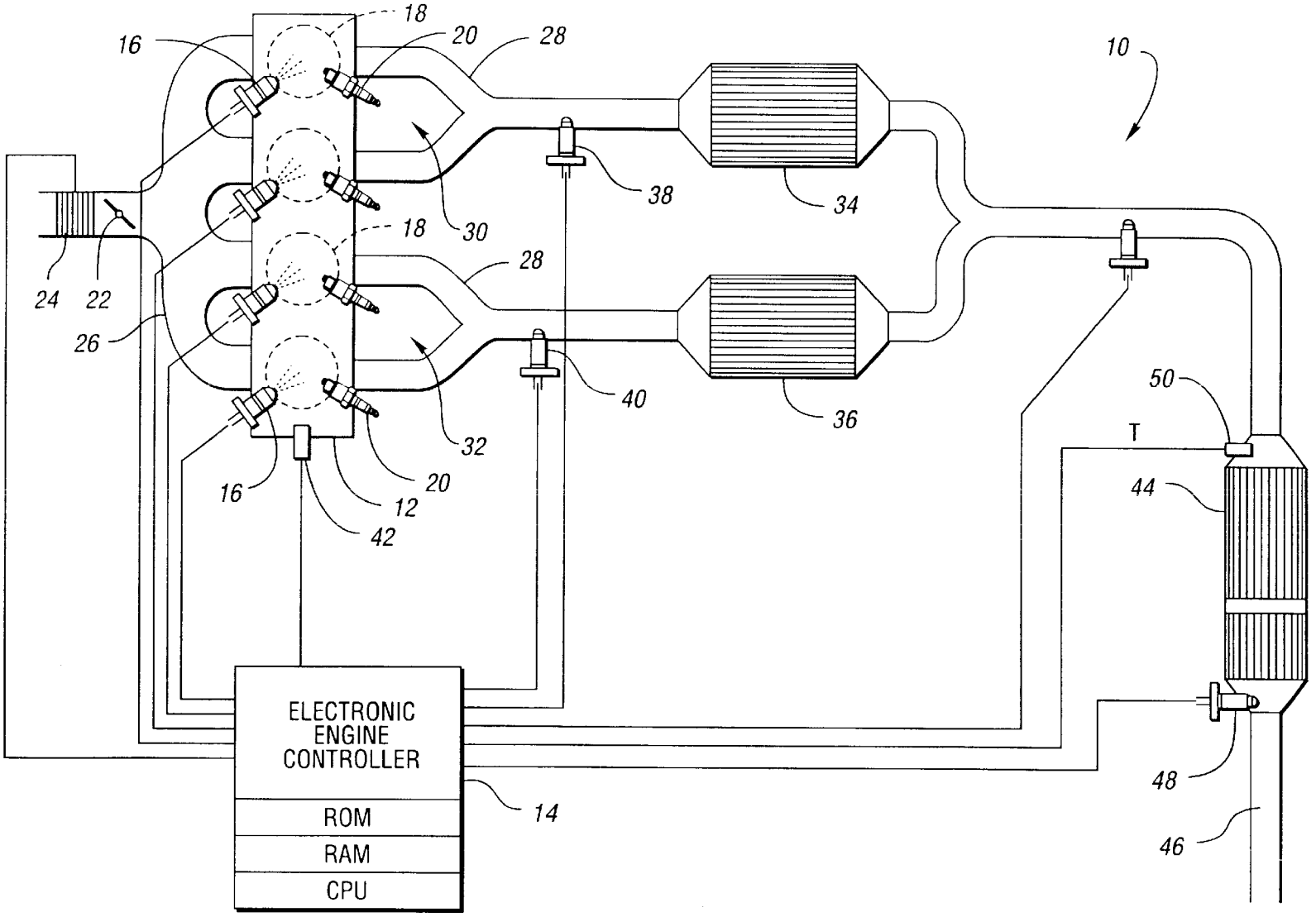
10
50
T
44
48
46
34
36
38
40
28
28
20
30
32
18
18
20
12
42
16
16
22
26
24
14
ELECTRONIC ENGINE CONTROLLER
ROM
RAM
CPU

METHOD AND SYSTEM FOR OPERATING DUAL-EXHAUST ENGINE

BACKGROUND OF THE INVENTION

1. Field of the Invention

The invention relates to methods and systems for improving the fuel economy achieved by "lean-burn" engines whose exhaust emission control devices periodically require engine operation at an air-fuel ratio rich of the stoichiometric air-fuel ratio.

2. Background Art

The prior art teaches use of an emission control device for a vehicle powered by a fuel-injected, internal combustion engine, such as a gasoline-powered engine, that "store" a constituent gas of the exhaust gas flowing through the device when the exhaust gas is lean, as when the engine is operated with a ratio of engine intake air to injected fuel greater than the stoichiometric air-fuel ratio. Any such "stored" constituent gas is subsequently "released" when the air-fuel ratio of the exhaust gas flowing through the device is subsequently made either equal to or rich of the stoichiometric air-fuel ratio, as occurs when the engine is operated with a ratio of engine intake air to injected fuel that is equal to or less than the stoichiometric air-fuel ratio. The prior art teaches the desirability of precisely controlling the time period during which the device stores the constituent gas (the "fill time") and the time period during which stored gas is released from the device (the "purge time") in order to maximize vehicle fuel efficiency obtained through lean-burn operation while otherwise seeking to minimize vehicle emissions.

Unfortunately, when oxygen-rich exhaust gas initially flows in series through a plurality of emission control devices during "lean" engine operation, excess oxygen is often stored in the upstream device. When the exhaust gas is later transitioned from "lean" to "rich," as when seeking to "purge" the stored constituent gas from the downstream device, the engine must burn a significant quantity of fuel with an air-fuel ratio rich of stoichiometric before HC and CO appears in the exhaust gas flowing out of the upstream device into the downstream device. More specifically, the oxygen previously stored in the upstream device must first be depleted by the excess hydrocarbons found in the rich device-purging air-fuel mixture before the excess hydrocarbons in the air-fuel mixture "break through" to the downstream device. This fuel penalty occurs each and every time the engine operating condition transitions from lean operation to rich operation, thereby significantly reducing the fuel savings otherwise associated with repeated lean operation of the engine.

And, as the frequency of device purge events increases due to the correlative decrease in nominal device efficiency due, for example, to the accumulation or "poisoning" of the downstream device with SOX, the fuel penalty associated with upstream device break-through also increases. Moreover, relatively higher vehicle loads may precipitate an increase in the temperature of the upstream device, whereupon the upstream device's nominal oxygen storage capacity and, hence, the fuel penalty associated with upstream device break-through, will also likely increase.

Further, for vehicles equipped with a pair of upstream emission control devices, as may be found in vehicles having either a "V"-configuration engine or an "I"-configuration engine with a split exhaust configuration, oxygen is stored in both upstream devices during lean operation. Accordingly, twice the amount of fuel is required upon transitioning from "lean" to "rich" engine operation before excess hydrocarbons (namely, HC and CO) break through the upstream devices for use in purging the stored constituent gas from the downstream device.

The inventors herein have recognized a need to provide a method and system for purifying the exhaust gas of an internal combustion engine which is characterized by a reduced fuel penalty when transitioning from lean to rich in order to effect a purge of a downstream emission control device, particularly for those exhaust systems which employ a pair of upstream emission control devices.

SUMMARY OF THE INVENTION

Under the invention, a method is provided for controlling the operation of an internal combustion engine having a plurality of cylinders respectively burning an air-fuel mixture to generate exhaust gas formed of one or more constituent gases, wherein each cylinder being associated with a selected one of exactly two cylinder groups, and wherein the exhaust gas from each cylinder group flows through a respective upstream emission control device and then through a common downstream emission control device, with the downstream device storing an amount of a selected constituent gas, such as $NO_x$, when the exhaust gas flowing through the downstream device is lean of a stoichiometric air-fuel ratio and releasing a previously-stored amount of the selected constituent gas when the exhaust gas flowing through the downstream device is rich of the stoichiometric air-fuel ratio. The method comprises supplying a first air-fuel mixture characterized by a first air-fuel ratio lean of the stoichiometric air-fuel ratio to each cylinder groups, whereby the selected constituent gas is stored in the downstream device; and determining a need for purging the downstream device of a previously-stored amount of the selected constituent gas. Upon determining such a need for purging the downstream device, the method further includes supplying a second air-fuel mixture to the cylinders of the first cylinder group while simultaneously supplying a third air-fuel mixture to the cylinders of the second cylinder group, wherein the second air-fuel mixture is characterized by a second air-fuel ratio at or near the stoichiometric air-fuel ratio (hereinafter a "near-stoichiometric air-fuel ratio") and the third air-fuel mixture is characterized by a third air-fuel ratio rich of the stoichiometric air-fuel ratio, such that, when the second and third air-fuel mixtures flow together through the device, the second and third air-fuel mixtures combine to form a fourth air-fuel mixture characterized by a fourth air-fuel ratio rich of the stoichiometric air-fuel ratio. In a preferred embodiment, the fourth air-fuel ratio is preferably perhaps about 0.97 times the stoichiometric air-fuel ratio and is preferably no greater than about 0.75.

In a preferred embodiment, the step of determining the need for releasing previously-stored constituent gas from the downstream device includes determining a value representing an estimate of the incremental amount of the selected constituent gas currently being stored in the downstream device; calculating a measure representing the cumulative amount of the selected constituent gas stored in the device during a given lean operation condition based on the incremental stored-$NO_x$ value; determining a value representing an instantaneous capacity for the downstream device to store the selected constituent gas; and comparing the cumulative measure to the determined capacity value. In a preferred embodiment, the step of calculating the incremental storage value includes determining values representing the effects of the instantaneous device temperature, the cumulative amount of the selected constituent gas which has already been stored in the device, and an estimate of the amount of sulfur which has accumulated in the device. Similarly, in a preferred embodiment, the step of determining the value for instantaneous device capacity includes determining values representing the instantaneous device temperature and the estimate of accumulated sulfur.

In accordance with another feature of the invention, the method preferably includes matching the torque output of the cylinders of the second cylinder group (operating with a relatively enriched air-fuel mixture) with that of the first cylinder group (operating at near-stoichiometry), as by retarding spark to the cylinders of the second cylinder group when operating those cylinders are operating with the enriched air-fuel mixture. Alternatively, the invention contemplates selecting the second and third air-fuel ratios, respectively, such that the torque generated by the cylinders of the second cylinder group operating with the third (enriched) air-fuel mixture is approximately equal to the torque generated by the cylinders of the first cylinder group operating with the second (near-stoichiometric) air-fuel mixture.

In accordance with the invention, the first upstream emission control, which receives the exhaust gas generated by the first cylinder group, does not release stored oxygen because the cylinders of the first cylinder group are not operated with an air-fuel mixture rich of stoichiometry. As a result, the invention improves overall vehicle fuel economy because only the second upstream emission control device, which receives the exhaust gas generated by the second cylinder group, is purged of stored oxygen during the purge event.

The above objects, features and advantages of the present invention are readily apparent from the following detailed description of the best mode for carrying out the invention when taken in connection with the accompanying drawings.

BRIEF DESCRIPTION OF THE DRAWING

The Drawing is a schematic of an exemplary engine system for practicing the invention.

DETAILED DESCRIPTION OF THE PREFERRED EMBODIMENT(S)

Referring to the Drawing, an exemplary control system 10 for a four-cylinder, gasoline-powered engine 12 for a motor vehicle includes an electronic engine controller 14 having ROM, RAM and a processor ("CPU") as indicated. The controller 14 controls the operation of each of a set of fuel injectors 16. The fuel injectors 16, which are of conventional design, are each positioned to inject fuel into a respective cylinder 18 of the engine 12 in precise quantities as determined by the controller 14. The controller 14 similarly controls the individual operation, i.e., timing, of the current directed through each of a set of spark plugs 20 in a known manner.

The controller 14 also controls an electronic throttle 22 that regulates the mass flow of air into the engine 12. An air mass flow sensor 24, positioned at the air intake of engine's intake manifold 26, provides a signal regarding the air mass flow resulting from positioning of the engine's throttle 22. The air flow signal from the air mass flow sensor 24 is utilized by the controller 14 to calculate an air mass value which is indicative of a mass of air flowing per unit time into the engine's induction system.

In accordance with the invention, the engine's exhaust manifold 28 serves to define a first cylinder group 30 and a second cylinder group 32. The exhaust gas generated during operation of the first cylinder group 30 is directed via appropriate exhaust piping to a first upstream emission control device 34, while the exhaust gas generated during operation of the second cylinder group 32 is similarly directed through a second upstream emission control device 36. Preferably, the second upstream device 36 features substantially lower oxygen storage during the initial portion of a given lean engine operating condition than the first upstream device 34, for reasons described more fully below.

An oxygen sensor 38,40 respectively positioned upstream of each upstream device 34,36 detects the oxygen content of the exhaust gas generated by the engine's respective cylinder groups 30,32 and transmits a respective representative output signal to the controller 14. The upstream oxygen sensors 38,40, which are "switching" heated exhaust gas oxygen (HEGO) sensors in a preferred embodiment, provide feedback to the controller 14 for improved control of the air-fuel ratio of the air-fuel mixture respectively supplied to the cylinders 18 corresponding to each cylinder group 30,32. Such use of the oxygen sensors 38,40 is particularly useful during operation of the engine 12 at or near a stoichiometric air-fuel ratio ($\lambda$=1.00). A plurality of other sensors, including an engine speed sensor and an engine load sensor, indicated generally at 42, also generate additional signals in a known manner for use by the controller 14.

The exhaust gas exiting each upstream device 34,36 is directed through a single, common downstream device 44, which functions in the manner described above to reduce the amount of a selected constituent gas, such as $NO_x$, exiting the vehicle tailpipe 46. The system 10 also includes an additional oxygen sensor 48, which may also be a switching-type HEGO sensor, positioned in the exhaust system downstream of the downstream device 44 for use in optimizing device fill and purge times. A temperature sensor 50 generates a signal representing the instantaneous temperature T of the device 44, also useful in optimizing the performance of the downstream device.

Upon commencing lean engine operation, the controller 14 adjusts the fuel injectors 16 to achieve a lean air-fuel mixture within the cylinders 18 of each cylinder group 30,32 having an air-fuel ratio greater than about 1.3 times the stoichiometric air-fuel ratio. For each subsequent background loop of the controller 14 during lean engine operation, the controller 14 determines a value representing the instantaneous rate at which $NO_x$ is being generated by the engine 12 as a function of instantaneous engine operating conditions, which may include, without limitation, engine speed, engine load, air-fuel ratio, percentage exhaust gas recirculation ("EGR"), and ignition timing ("spark"). By way of example only, in a preferred embodiment, the controller 14 retrieves a stored estimate $R_{i,j}$ for the instantaneous $NO_x$-generation rate from a lookup table stored in ROM based upon sensed values for engine speed and load, wherein the stored estimates $R_{i,j}$ are originally obtained from engine mapping data.

During lean operation, the controller 14 calculates an instantaneous value INCREMENTAL_NOX representing the incremental amount of $NO_x$ stored in the device 44 during each background loop executed by the controller 14 during a given lean operating condition, in accordance with the following formula:

$$\text{INCREMENTAL_NOX}=R_{i,j}*t_{i,j}*\mu,$$

where: $t_{i,j}$ is the length of time that the engine is operated within a given engine speed/load cell for which the $NO_x$ generation rate $R_{i,j}$ applies and, typically, is assumed to be the duration of a nominal background loop; and $\mu$ represents a set of adjustment factors for instantaneous device temperature T, open-loop accumulation of $SO_x$ in the device 44 (which, in a preferred embodiment, is itself generated as a function of fuel flow and device temperature T), desired device utilization percentage, and a current estimate of the cumulative amount of $NO_x$ which has already been stored in the downstream device 44 during the given lean operating condition.

The controller 14 iteratively updates a stored value TOTAL_NOX representing the cumulative amount of $NO_x$ which has been stored in the downstream device 44 during the given lean operating condition, in accordance with the following formula:

$$\text{TOTAL_NOX} \leftarrow \text{TOTAL_NOX} + \text{INCREMENTAL_NOX}$$

The controller 14 further determines a suitable value NOX_CAP representing the instantaneous $NO_x$-storage capacity estimate for the device 44. By way of example only, in a preferred embodiment, the value NOX_CAP varies as a function of device temperature T, as further modified by an adaption factor $K_i$ periodically updated during fill-time optimization to reflect the impact of both temporary and permanent sulfur poisoning, device aging, and other device-deterioration effects.

The controller 14 then compares the updated value TOTAL_NOX representing the cumulative amount of $NO_x$ stored in the downstream device 44 with the determined value NOX_CAP representing the downstream device's instantaneous $NO_x$-storage capacity. The controller 14 discontinues the given lean operating condition and schedules a purge event when the updated value TOTAL_NOX exceeds the determined value NOX_CAP.

In addition, if the controller 14 determines that the engine 12 is operating in a region having an excessively high instantaneous $NO_x$-generation rate $R_{i,j}$ such that tailpipe $NO_x$ emissions remain excessive notwithstanding storage by the downstream device 44 of a percentage of the generated $NO_x$, the controller 14 immediately schedules a purge event using an open-loop purge time based on the current value TOTAL_NOX representing the cumulative amount of $NO_x$ which has been stored in the downstream device 44 during the preceding lean operating condition.

If, at the end of the purge event, the controller 14 determines that the engine 12 is still operating within a region characterized by an excessively high $NO_x$ generation rate, the controller 14 will change the air-fuel ratio of the air-fuel mixture supplied to the cylinders 18 of the second cylinder bank 32 back to a near-stoichiometric air-fuel ratio. When the controller 14 determines the engine 12 is no longer operating within the excessively high $NO_x$ generation rate, the controller 14 either switches the air-fuel ratio of the air-fuel mixture supplied to both cylinder groups 30,32 back to a lean air-fuel ratio, or schedules another open-loop purge.

In accordance with another feature of the invention, the controller 14 preferably retards the spark for the "rich" cylinders 18 of the engine's second cylinder group 32 during the purge event, such that the torque generated by the cylinders 18 of the second cylinder group 32 more closely matches that of the "stoichiometric" cylinders 18 of the engine's first cylinder group 30. Alternatively, the invention contemplates further enrichment of the air-fuel ratio ("AFR") burned in the "rich" cylinders 18 of the second cylinder group 32 to provide a relatively matched torque output from both rich and stoichiometric cylinder groups 30,32, as seen in the following Table:

| AFR of "Rich" Second Cylinder Group (Stoichiometric AFR = 1.00) | Torque Ratio, Second (Rich) Cylinder Group to First (Stoichiometric) Cylinder Group |
|---|---|
| 0.70 | 1.02 |
| 0.80 | 1.05104 |
| 0.85 | 1.06044 |
| 0.90 | 1.05202 |
| 0.95 | 1.0306 |

Thus, in a preferred embodiment, the rich cylinders 18 of the second cylinder group 32 are operated at an air-fuel ratio of perhaps about 0.7 during the downstream device purge event, thereby requiring only minimal spark adjustment to match the torque output of the second cylinder group 32 with that of the first cylinder group 30 operating at near-stoichiometry.

Additionally, in accordance with another feature of the invention, the controller 14 further preferably selects the "depth" or degree of relative richness of the air-fuel mixture supplied to the second cylinder group 32 during the purge event as a function of engine operating conditions, for example, engine speed and load, and vehicle speed and acceleration. More specifically, the overall downstream air-fuel ratio, achieved upon the mixing together of the effluent streams from the upstream devices 34,36, preferably ranges from about 0.65 for relatively "low-speed" operating conditions to about 0.75 for relatively "high-speed" operating conditions.

In accordance with yet another feature of the invention, upon the scheduling of a desulfation event, the air-fuel mixture supplied to the engine's first cylinder group 30 is made "rich" while the air-fuel mixture supplied to the engine's second cylinder group 32 is made "lean." Spark timing in the rich cylinders is preferably retarded to balance the torque generated by the "rich" cylinders relative to the "lean" cylinders. The excess oxygen in the "lean" cylinder group exhaust mixes in the downstream device 44 with the excess CO and HC in the "rich" cylinder bank exhaust to provide an exothermic reaction, whereby the instantaneous temperature within the downstream device 44 is raised above the predetermined temperature threshold $T_{deSOx}$ of perhaps about 625–650° C. necessary for desulfation. Depending upon operating conditions, a period of perhaps 3–4 minutes may be required to raise the device temperature T above the predetermined temperature threshold $T_{deSOx}$.

Once the device temperature is raised above the predetermined temperature threshold $T_{deSOx}$, the overall engine air-fuel mixture is normalized/biased to "slightly rich," e.g., to achieve an air-fuel ratio at the tailpipe of about 0.97–0.98. Specifically, the enriched cylinders go slightly richer so as to obtain an overall average air-fuel ratio that is slightly rich. It is noted that, in a preferred embodiment, any further enrichment beyond 0.97 is preferably avoided to prevent undue generation of $H_2S$.

The "slightly rich" operating condition is maintained for perhaps about 3–4 minutes in order to fully release accumulated sulfur. In a preferred embodiment, a loop counter is used to time the cumulative duration of the desulfation event. If it becomes necessary to "break out" of the slightly rich "de$SO_x$ing" operating condition, as where the vehicle operator initiates a "hard" acceleration, the controller 14 can thereafter return to the slightly rich operating condition to continue desulfation. If, as a result of such a break-out condition, the instantaneous device temperature drops below the predetermined temperature threshold $T_{deSOx}$, or if the nominal temperature of the downstream device 44 during the desulfation event should otherwise fall below the predetermined temperature threshold $T_{deSOx}$, the controller 14 will switch the air-fuel mixture supplied to the second cylinder group 32 to slightly lean to thereby resume exothermic heating of the downstream device 44 as described above. The "slightly rich" air-fuel ratio is thereafter restored for the remainder of the desulfation event, i.e., until the counter times out, thereby indicating a desulfated or renewed downstream device 44.

While an exemplary method and system for carrying out the invention has been described in detail, those familiar with the art to which this invention relates will recognize various alternative designs and embodiments for practicing the invention within the scope of the appended claims. For example, while the exemplary exhaust gas treatment system described above includes a downstream HEGO or "switching" oxygen sensor, the invention contemplates use of other types of oxygen sensors, e.g., sensors capable of generating a proportional output, including linear-type output sensors such as a universal exhaust gas oxygen (UEGO) sensor.

What is claimed:

1. A method of controlling the operation of an internal combustion engine having a plurality of cylinders respectively burning an air-fuel mixture to generate exhaust gas, each cylinder being associated with a selected one of exactly two cylinder groups, the exhaust gas from each cylinder group flowing through a respective one of a pair of upstream emission control devices and a common downstream emission control device, the downstream device storing a selected constituent gas of the exhaust gas when the exhaust gas flowing through the second device is lean of a stoichiometric air-fuel ratio and releasing previously-stored constituent gas when the exhaust gas flowing through the trap is rich of the stoichiometric air-fuel ratio, the method comprising:

supplying a first air-fuel mixture to each cylinder group, wherein the first air-fuel mixture is characterized by a first air-fuel ratio lean of the stoichiometric air-fuel ratio, whereby an amount of the selected constituent gas is stored in the trap;

determining a need for releasing previously stored constituent gas from the downstream device; and in response to determining a need for releasing previously stored constituent gas from the downstream device, supplying a second air-fuel mixture to the cylinders of the first cylinder group while simultaneously supplying a third air-fuel mixture to the cylinders of the second cylinder group, wherein the second air-fuel mixture is characterized by a stoichiometric second air-fuel ratio and the third air-fuel mixture is characterized by a third air-fuel ratio rich of the stoichiometric air-fuel ratio, and wherein the second and third air-fuel mixtures combine to form a fourth air-fuel mixture flowing through the trap, the fourth air-fuel mixture being characterized by a fourth air-fuel ratio rich of the stoichiometric air-fuel ratio.

2. The method of claim 1, wherein determining the need for releasing previously-stored constituent gas from the downstream device includes:

calculating a first measure representing a cumulative amount of the selected constituent gas stored in the device when supplying the first air-fuel mixture; determining a reference value representing an instantaneous capacity of the downstream device to store the selected constituent gas; and comparing the first measure to the reference value.

3. The method of claim 1, wherein the fourth air-fuel ratio, when normalized by the stoichiometric air-fuel ratio, is no greater than about 0.75.

4. The method of claim 1, including retarding spark to the second cylinder group when supplying the third air-fuel mixture to the second cylinder group.

5. The method of claim 1, including selecting the second and third air-fuel ratios, respectively, such that a first torque generated upon operation of the cylinders of the first cylinder group using the second air-fuel mixture is approximately equal to a second torque generated upon operation of the cylinders of the second cylinder group using the third air-fuel mixture.

6. A system for controlling the operation of an internal combustion engine, wherein the engine includes a plurality of cylinders respectively burning an air-fuel mixture to generate exhaust gas, each cylinder being associated with a selected one of exactly two cylinder groups, the exhaust gas from each cylinder group flowing through a respective one of a plurality of upstream emission control devices and a common downstream emission control device, the downstream device storing an amount of a selected constituent gas of the exhaust gas when the exhaust gas flowing through the downstream device is lean of a stoichiometric air-fuel ratio and releasing previously-stored constituent gas when the exhaust gas flowing through the downstream device is rich of the stoichiometric air-fuel ratio, the system comprising:

a controller including a microprocessor arranged to supply a first air-fuel mixture to each cylinder group, the first air-fuel mixture being characterized by a first air-fuel ratio lean of the stoichiometric air-fuel ratio, whereby an amount of $NO_x$ is stored in the trap, and wherein the controller is further arranged to determine a need for releasing previously stored $NO_x$ from the trap and, in response to determining a need for releasing previously stored $NO_x$, to supply a second air-fuel mixture to the cylinders of the first cylinder group while simultaneously supplying a third air-fuel mixture to the cylinders of the second cylinder group, the second air-fuel mixture being characterized by a stoichiometric second air-fuel ratio and the third air-fuel mixture being characterized by a third air-fuel ratio rich of the stoichiometric air-fuel ratio, the second and third air-fuel mixtures combining to form a fourth air-fuel mixture flowing through the trap, and the fourth air-fuel mixture being characterized by a fourth air-fuel ratio rich of the stoichiometric air-fuel ratio.

7. The system of claim 6, wherein the controller is further arranged to calculate a first measure representing a cumulative amount of $NO_x$ stored in the device when supplying the first air-fuel mixture, to determine a reference value representing an instantaneous $NO_x$-storage capacity for the device, and to compare the first measure to the reference value.

8. The system of claim 6, wherein the controller is further arranged to retard spark to the second cylinder group when operating the second cylinder group with the third air-fuel mixture.

9. The system of claim 8, wherein the controller is further arranged to select the second and third air-fuel ratios, respectively, such that a first torque generated upon operation of the cylinders of the first cylinder group using the second air-fuel mixture is approximately equal to a second torque generated upon operation of the cylinders of the second cylinder group using the third air-fuel mixture.

10. A method of controlling the operation of an internal combustion engine having a plurality of cylinders respectively burning an air-fuel mixture to generate exhaust gas, each cylinder being associated with a selected one of exactly two cylinder groups, the exhaust gas from each cylinder flowing through a selected one of a plurality of upstream emission control device before flowing as a combined exhaust gas through a common downstream emission control device, the downstream device storing an amount of a selected constituent gas of the exhaust gas when the exhaust gas flowing through the downstream device is lean of a stoichiometric air-fuel ratio and releasing previously-stored constituent gas when the exhaust gas flowing through the device is rich of the stoichiometric air-fuel ratio, the method comprising:

determining a need for releasing previously-stored constituent gas from the downstream device; and in response to determining a need for releasing previously-stored constituent gas, operating the cylinders of the first cylinder group with a stoichiometric air-fuel mixture while simultaneously operating the cylinders of the second cylinder group with a first rich air-fuel mixture to thereby release previously-stored constituent gas from the downstream device.

11. The method of claim 10, wherein the combined exhaust gas from the cylinders of the first and second cylinder groups when operating with the stoichiometric air-fuel mixture and the first rich air-fuel mixture, respectively, is characterized by an air-fuel ratio of no greater than about 0.75.

12. The method of claim 10, including retarding spark to the second cylinder group when supplying the first rich air-fuel mixture to the cylinders of the second cylinder group.

13. The method of claim 10, including balancing the torque output of the first and second cylinder groups when respectively operating the first and second cylinder groups with the stoichiometric air-fuel mixture and the first rich air-fuel mixture.

* * * * *